US010113500B2

(12) United States Patent
Hayami

(10) Patent No.: US 10,113,500 B2
(45) Date of Patent: Oct. 30, 2018

(54) FUEL-PRESSURE CONTROLLER FOR DIRECT INJECTION ENGINE

(75) Inventor: Toshifumi Hayami, Kariya (JP)

(73) Assignee: DENSO CORPORATION, Kariya (JP)

( * ) Notice: Subject to any disclaimer, the term of this patent is extended or adjusted under 35 U.S.C. 154(b) by 2595 days.

(21) Appl. No.: 12/766,030

(22) Filed: Apr. 23, 2010

(65) Prior Publication Data

US 2010/0274467 A1 Oct. 28, 2010

(30) Foreign Application Priority Data

Apr. 23, 2009 (JP) ..... 2009-105728

(51) Int. Cl.

| | |
|---|---|
| ***F02D 1/00*** | (2006.01) |
| ***F02D 41/38*** | (2006.01) |
| ***F02D 41/24*** | (2006.01) |
| ***F02D 41/30*** | (2006.01) |

(52) U.S. Cl.

CPC ..... *F02D 41/3854* (2013.01); *F02D 41/2438* (2013.01); *F02D 41/2464* (2013.01); *F02D 41/3082* (2013.01); *F02D 2200/0602* (2013.01); *F02D 2250/31* (2013.01)

(58) Field of Classification Search

USPC ..... 123/446, 458, 497, 514; 701/103

See application file for complete search history.

(56) References Cited

U.S. PATENT DOCUMENTS

| | | | | |
|---|---|---|---|---|
| 4,423,485 | A * | 12/1983 | Sami et al. | 701/104 |
| 5,392,740 | A * | 2/1995 | Teramoto et al. | 123/3 |
| 5,483,940 | A | 1/1996 | Namba et al. | |
| 6,131,500 | A * | 10/2000 | Moncrief | 91/361 |
| 6,708,671 | B1 * | 3/2004 | Joos et al. | 123/464 |
| 7,331,328 | B2 * | 2/2008 | Mashiki | 123/431 |
| 2007/0251501 | A1 | 11/2007 | Sawut et al. | |

FOREIGN PATENT DOCUMENTS

| | | |
|---|---|---|
| JP | S59-150970 | 8/1984 |
| JP | H02-90355 | 7/1990 |
| JP | H10-009073 | 1/1998 |

(Continued)

OTHER PUBLICATIONS

Japanese Official Action dated Sep. 25, 2012 issued in corresponding Japanese Application No. 2009-105728, with English translation.

*Primary Examiner* — David Hamaoui

(74) *Attorney, Agent, or Firm* — Nixon & Vanderhye P.C.

(57) ABSTRACT

When a specified learning execute condition is established, the high-pressure pump is stopped so that the fuel pressure in the high pressure fuel passage is made equal to the fuel pressure in the low pressure fuel passage. A low pressure fuel control is executed to control a driving voltage of the low-pressure pump based on the operational characteristic of the low-pressure pump. A driving voltage of the low-pressure pump is gradually corrected so that the difference between the detected high fuel pressure and a target low fuel pressure becomes small. A driving voltage correcting amount is learned as the control error of the low pressure fuel control. The driving voltage correction amount is stored as the learning correction amount, and the driving voltage of the low-pressure pump is corrected by means of the learning correction amount.

2 Claims, 6 Drawing Sheets

(56) References Cited

FOREIGN PATENT DOCUMENTS

| | | |
|---|---|---|
| JP | H11-173230 | 6/1999 |
| JP | 2003-83103 | 3/2003 |
| JP | 2003-222060 | 8/2003 |
| JP | 2006-322412 | 11/2006 |
| JP | 2006-342733 | 12/2006 |

* cited by examiner

FUEL-PRESSURE CONTROLLER FOR DIRECT INJECTION ENGINE

CROSS-REFERENCE TO RELATED APPLICATION

This application is based on Japanese Patent Application No. 2009-105728 filed on Apr. 23, 2009, the disclosure of which is incorporated herein by reference.

FIELD OF THE INVENTION

The present invention relates to a fuel-pressure controller for a direct injection engine. A low-pressure pump pumps up a fuel from a fuel tank and supplies the fuel to a high-pressure pump. The high-pressure pump pressurizes the fuel and discharges the high-pressure fuel toward a fuel injector.

BACKGROUND OF THE INVENTION

In the direct injection engine, since a time interval from a fuel injection until a fuel combustion is relatively short, it is necessary to increase a fuel injection pressure for atomizing the fuel. An electric low-pressure pump pumps up the fuel from a fuel tank. A mechanical high-pressure pump pressurizes the fuel and discharges the fuel toward the fuel injector.

Generally, in the direct injection engine, a fuel pressure sensor is provided to detect a fuel pressure which is supplied to the injector. A discharge rate of the high-pressure pump is feedback controlled in such a manner that the detected fuel pressure agrees with a target fuel pressure. The low-pressure pump is driven under a specified constant condition (constant driving voltage), and a pressure regulator adjusts the discharge pressure of the low-pressure pump.

The low-pressure pump is driven under the constant condition even if a fuel consumption is varied. Thus, in a case that the fuel consumption is low, a discharge rate of the low-pressure pump is excessive, which may waste a battery voltage to deteriorate the fuel economy.

In view of the above, it is required that the discharge rate of the low-pressure pump is made as low as possible to improve the fuel economy. However, if the discharge rate of the low-pressure pump is made low, the fuel pressure in a low-pressure fuel passage between the low-pressure pump and the high-pressure pump is also decreased. It is likely that the fuel is evaporated in the low pressure fuel passage to generate a vapor when the high-pressure pump suctions the fuel. Such a vapor may deteriorate a fuel discharge efficiency of the high-pressure pump, so that the discharge pressure of the high-pressure pump can not be brought to a target fuel pressure and a malfunction may be caused in the high-pressure pump.

A patent document 1 (JP-2003-222060A) shows a technology of preventing a generation of vapor, in which a temperature-pressure relation expression is previously established and a target pressure P0 is derived from the temperature-pressure relation expression. A fuel pressure P1 at which a vapor (cavitation) is actually generated in the high-pressure pump is obtained. Based on a difference between the target pressure P0 and the fuel pressure P1, the temperature-pressure expression is corrected.

Moreover, in a port injection engine equipped with a low-pressure fuel pump without a high-pressure pump, as shown in a patent document 2 (Japanese Patent No. 3060266: U.S. Pat. No. 5,483,940) and a patent document 3 (JP-2007-315378A: US-2007-0251501A1), a fuel pressure sensor is provided to detect a fuel pressure discharged from the fuel pump and the fuel pump is feedback controlled such that the detected fuel pressure agrees with the target fuel pressure.

However, in the technology shown in the patent document 1, it is necessary to actually generate a vapor in the high-pressure pump when the temperature-pressure expression is corrected. Thus, it is likely that a malfunction may be caused in the high-pressure pump by the vapor and a reliability of the fuel supply system may be deteriorated.

Further, it is conceivable that the technologies shown in the patent document 1 and the patent document 2 are applied to a fuel injection system having a low-pressure pump and a high-pressure pump. A fuel pressure sensor is provided for detecting a fuel pressure in a low-pressure fuel passage. The low-pressure pump is feedback controlled in such a manner that the detected fuel pressure agrees with a target fuel pressure to restrict a generation of vapor. However, in this case, both the fuel pressure sensor detecting low pressure fuel and the fuel pressure sensor detecting high fuel pressure are necessary, which increase a product cost of the fuel injection system.

SUMMARY OF THE INVENTION

The present invention is made in view of the above matters, and it is an object of the present invention to provide a fuel-pressure controller for a direct injection engine, which is capable of controlling a fuel pressure in a low-pressure fuel passage so as to agree with a target fuel pressure while restricting a generation of vapor.

A direct injection engine is provided with a low-pressure pump and a high-pressure pump. The low-pressure pump pumps up a fuel in a fuel tank and supplies the fuel to the high-pressure pump. The high-pressure pump pressurizes the fuel and discharges a high-pressure fuel toward a fuel injector.

The fuel-pressure controller includes: a low pressure fuel control means for controlling the low-pressure pump in such a manner that a fuel pressure in a low pressure fuel passage agrees with a target low pressure fuel; a high-fuel-pressure sensor detecting a fuel pressure in a high pressure fuel passage through which the fuel is supplied from the high-pressure pump to the fuel injector; a learning means for executing the low pressure fuel control in a case that a specified learning execution condition is satisfied while a fuel discharge operation of the high-fuel pump is stopped, and for learning a control error in the low pressure fuel control based on a difference between a high fuel pressure detected by the high-fuel-pressure sensor and the target low fuel pressure; and a correction means for correcting a control amount of the low pressure fuel control based on the control error learned by the learning means.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

Embodiments of the present invention will be described, hereinafter.

First Embodiment

Figure 1:
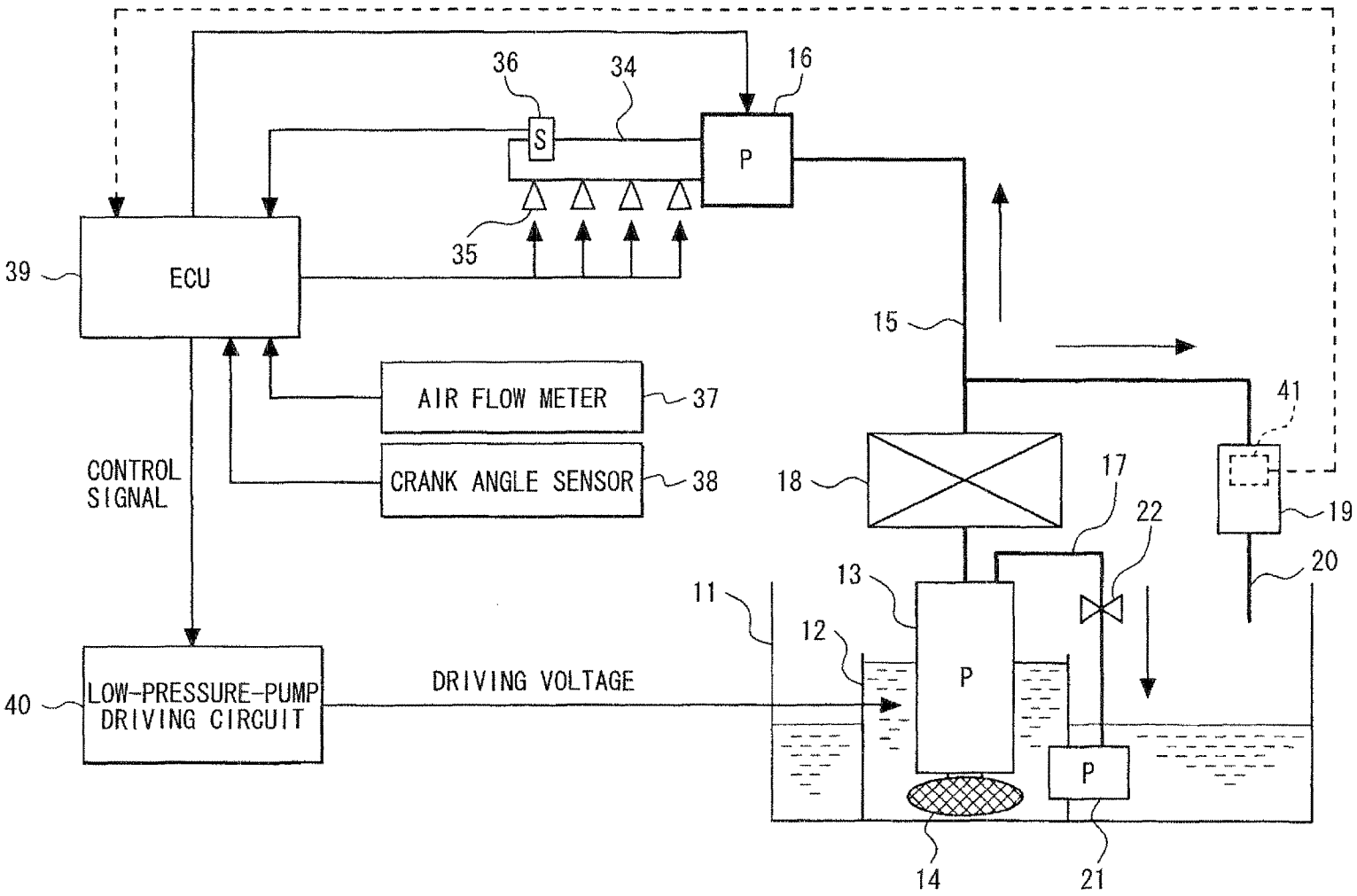
FIG. 1 is a schematic view of a fuel supply system according to a first embodiment of the present invention.

Referring to FIGS. 1 to 5, a first embodiment will be described hereinafter. FIG. 1 schematically shows a fuel supply system for a direct injection engine.

A fuel tank 11 is provided with a sub-tank 12 therein. When the fuel quantity stored in the fuel tank 11 is relatively low, the fuel is gathered into the sub-tank 12 by a jet pump 21.

A low-pressure pump 13 is arranged in the sub-tank 12. A suction filter 14 is provided at an inlet of the low-pressure pump 13. The low-pressure pump 13 is driven by an electric motor (not shown). A part of a fuel discharged from the low-pressure pump 13 is introduced into a high-pressure pump 16 through a low-pressure fuel pipe 15. The other of the fuel is introduced to the jet pump 21 through a return pipe 17.

A fuel filter 18 is provided in the low-pressure fuel pipe 15 in order to filtrate the fuel discharged from the low-pressure pump 13. Further, a pressure regulator 19 is connected to the low-pressure fuel pipe 15. When the fuel pressure in the low-pressure fuel pipe 15 exceeds a specified value (for example, 650 kPa), the pressure regulator 19 is opened to return the fuel in the low-pressure fuel pipe 15 to the fuel tank 11 so that the fuel pressure in the low-pressure fuel pipe 15 is maintained under the specified value. A return pipe 20 is connected to the pressure regulator 19.

The jet pump 21 is provided at a lower portion of the sub-tank 12. The jet pump 21 supplies the fuel in the fuel tank 11 into the sub-tank 12. The return pipe 17 is connected to an inlet of the jet pump 21. An orifice 22 is provided in the return pipe 17, which restricts fuel quantity supplied to the jet pump 21. The return pipe 20 may be connected to the return pipe 17 or the jet pump 21.

Figure 2:
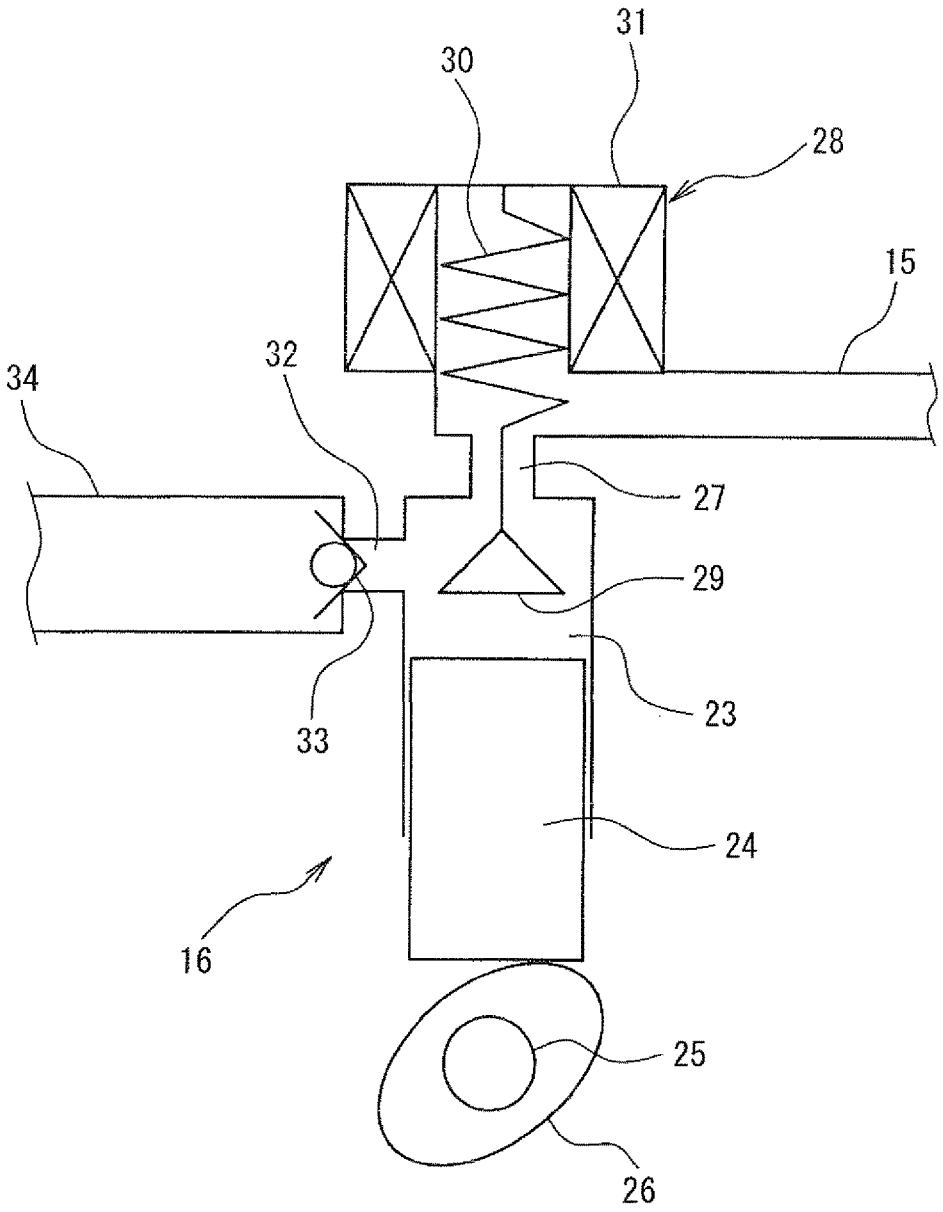
FIG. 2 is a schematic view of a high-pressure pump.

As shown in FIG. 2, the high-pressure pump 16 is a piston pump having a piston 24 which reciprocates in a pump chamber 23. The piston 24 is driven by a cam 26 connected to a camshaft 25. The high-pressure pump 16 is equipped with a fuel pressure control valve 28 at its inlet port 27. The fuel pressure control valve 28 is a normally opened electromagnetic valve having a valve body 29, a spring 30 biasing the valve body 29 in its opening direction, and a solenoid 31 attracting the valve body 29 in its closing direction.

When the high-pressure pump 16 is in a suction stroke, the fuel pressure control valve 28 is opened so that the fuel is suctioned into the pump chamber 23. When the high-pressure pump 16 is in a discharge stroke, a closing timing of the fuel pressure control valve 28 (that is, an energization timing of the solenoid 31) is controlled to adjust a discharge rate and a discharge pressure of the high-pressure pump 16.

When it is intended to increase the fuel pressure, a closing timing of the fuel pressure control valve 28 is advanced to increase the discharge rate of the fuel pressure control valve 28. When it is intended to decrease the fuel pressure, a closing timing of the fuel pressure control valve 28 is retarded to decrease the discharge rate of the fuel pressure control valve 28.

A check valve 33 is provided at an outlet port 32 of the high-pressure pump 16. The fuel discharged from a high-pressure pump 16 is introduced into a delivery pipe 34, and is distributed to each of fuel injectors 35 arranged on an upper portion of each cylinder. The delivery pipe 34 is provided with a high fuel pressure sensor 36 detecting a fuel pressure in the delivery pipe 34.

Moreover, an air flow meter 37 which detects the intake air flow rate, and a crank angle sensor 38 which outputs pulse signals for every specified crank angle in synchronization with a rotation of a crankshaft (not shown) are provided in the engine. A crank angle and an engine speed are detected based on the output signal of the crank angle sensor 38.

The outputs from the above sensors are inputted into an electronic control unit 39, which is referred to an ECU 39 hereinafter. The ECU 39 includes a microcomputer which executes an engine control program stored in a Read Only Memory (ROM) to control a fuel injection quantity of the fuel injector 35 and an ignition timing of a spark plug (not shown) according to an engine running condition. The ECU 39 performs a feedback control with respect to the discharge rate of the high-pressure pump 16 so that the fuel pressure detected by the high fuel pressure sensor 36 agrees with a target high fuel pressure.

Moreover, the ECU 39 outputs a control signal to a low-pressure-pump driving circuit 40 which drives the low-pressure pump 13. Specifically, the ECU 39 executes a low pressure fuel control routine shown in FIG. 3, which will be described later. Based on an operational characteristic of the low-pressure pump 13, which is previously stored in a memory, a driving current of the low-pressure pump 13 is controlled so that the fuel pressure in the low-pressure fuel passage agrees with the target low fuel pressure. This processing is referred to as a low pressure fuel control. The operational characteristic of the low-pressure pump 13 represents a relationship between the driving voltage, the discharge rate and the discharge pressure. The target low fuel pressure is a fuel pressure necessary for preventing a generation of vapor. If a control error arises in the low pressure fuel control due to an individual difference (manufacturing dispersion) or deterioration with age in the low-pressure pump 13 and/or a low-pressure-pump driving circuit 40, the fuel pressure in the low pressure fuel passage is hardly controlled to the target low fuel pressure with high accuracy.

If the fuel pressure control valve 28 has been opened to stop a fuel discharge of the high-pressure pump 16, the fuel in the delivery pipe 34 is injected to a combustion chamber of the engine through the fuel injector 35, so that the fuel pressure in the delivery pipe 34 decreases and the fuel pressure in the high pressure fuel passage becomes equal to the fuel pressure in the low pressure fuel passage. In other words, the high fuel pressure sensor 36 can detects the fuel pressure in the low pressure fuel passage. The ECU 39 executes a control error learning routine shown in FIG. 4. When a specified learning execute condition is established, the high-pressure pump 16 is stopped so that the fuel pressure in the high pressure fuel passage is made equal to the fuel pressure in the low pressure fuel passage. The low pressure fuel control is executed so that the fuel pressure in the low pressure fuel passage agrees with the target low fuel pressure based on the operational characteristics of the low-pressure pump 13. While executing the low pressure fuel control, a control error of the low pressure fuel control is learned based on a difference between the high fuel pressure (=low fuel pressure) detected by the high fuel pressure sensor 36 and the target low fuel pressure.

The difference between the detected high fuel pressure (=low fuel pressure) and the target low fuel pressure is generated due to a control error of the low pressure fuel control. As the control error of the low pressure fuel control becomes larger, the difference between the detected high fuel pressure and the target low fuel pressure becomes larger. This pressure difference is a parameter indicative of the control error of the low pressure fuel control. Thus, the control error of the low pressure fuel control can be accurately learned based on the above pressure difference.

Specifically, during the low pressure fuel control, the driving voltage of the low-pressure pump 13 is gradually corrected so that the difference between the detected high fuel pressure and the target low fuel pressure becomes small. When the pressure difference becomes lower than a specified value or becomes substantially zero, the corrected amount of the driving voltage is learned as a control error of the low pressure fuel control (an error in driving voltage of the low-pressure pump 13). Since the correction amount by which the difference between the detected high fuel pressure and the target low fuel pressure becomes lower than the specified value corresponds to an error in driving voltage of the low-pressure pump 13, the control error of the low pressure fuel control can be accurately learned.

Therefore, even if a control error arises in the low pressure fuel control due to the individual difference and/or a deterioration with age in low-pressure pump 13 and/or the low-pressure-pump driving circuit 40, the fuel pressure in the low-pressure fuel passage is accurately adjusted to the target low fuel pressure.

Figure 3:
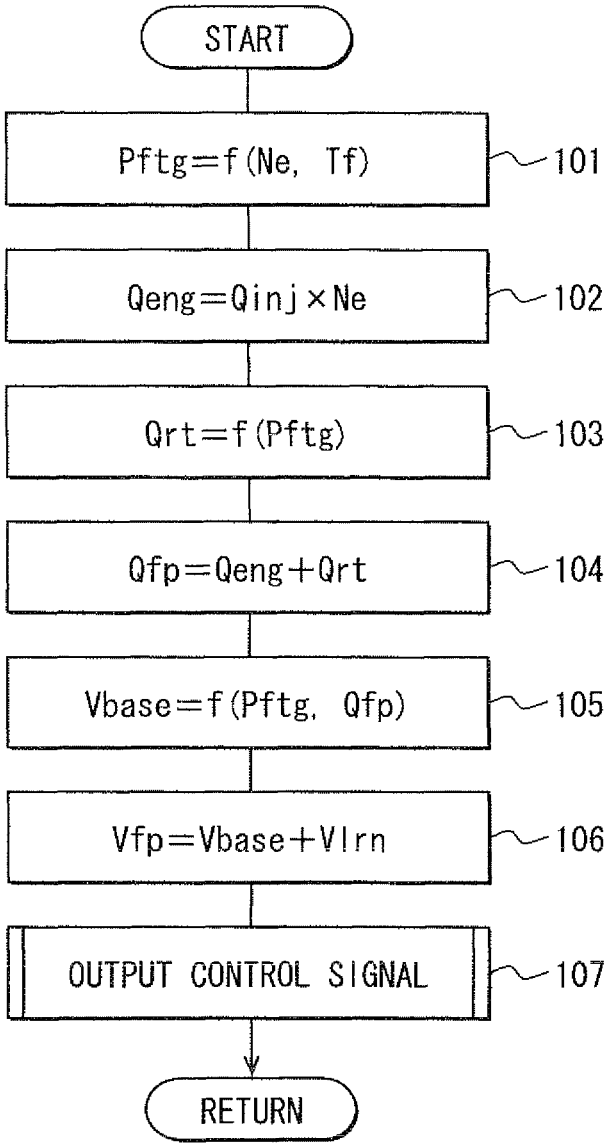
FIG. 3 is a flow chart showing a processing of a low pressure fuel control according to the first embodiment.
Figure 4:
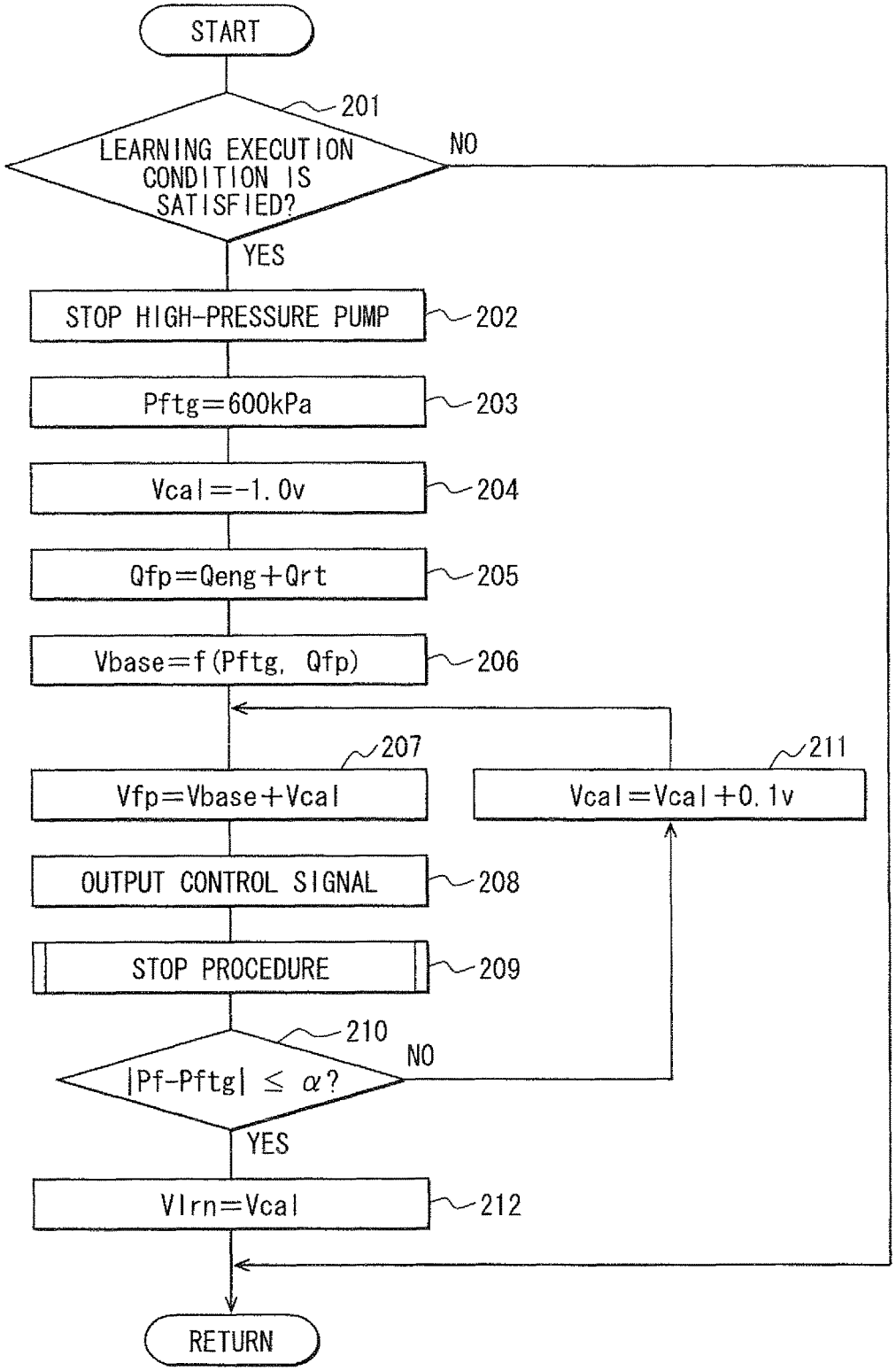
FIG. 4 is a flow chart showing a processing of a control error learning routine according to the first embodiment.

Referring to FIGS. 3 and 4, the low pressure fuel control routine and the control error learning routine will be described hereinafter.

[Low-Pressure-Fuel Control Routine]

The low pressure fuel control routine shown in FIG. 3 is repeatedly executed in a specified cycle while the ECU 39 is ON. This control routine corresponds to a low pressure fuel control means. In step 101, the target low fuel pressure Pftg is computed according to an engine speed Ne and a fuel temperature Tf by use of a map or a mathematical formula. It should be noted that the target low fuel pressure Pftg represents a minimum fuel pressure necessary for restricting a generation of vapor. The map or the mathematical formula for obtaining the target low fuel pressure Pftg is established in consideration that the suction fuel pressure of the high-pressure pump 16 varies according to the engine speed Ne and the fuel pressure at which a vapor is generated varies according to the fuel temperature Tf. The fuel temperature Tf can be detected by a temperature sensor, or can be estimated based on engine coolant temperature or engine oil temperature.

Then, the procedure proceeds to step 102 in which a required fuel injection quantity Qeng is computed by multiplying a fuel injection quantity Qinj by the engine speed Ne. The fuel injection quantity Qinj represents a total fuel injection quantity injected from each fuel injector 35. Then, the procedure proceeds to step 103 in which a return fuel quantity Qrt depending on the target low fuel pressure Pftg is computed by use of a map or a mathematical formula. The return fuel quantity Qrt is a quantity of fuel flowing through the return pipe 17.

Then, the procedure proceeds to step 104 in which the return fuel quantity Qrt is added to the required fuel injection quantity Qeng to obtain a required discharge rate Qfp of the low-pressure pump 13.

$$Qfp = Qeng + Qrt$$

Figure 5:
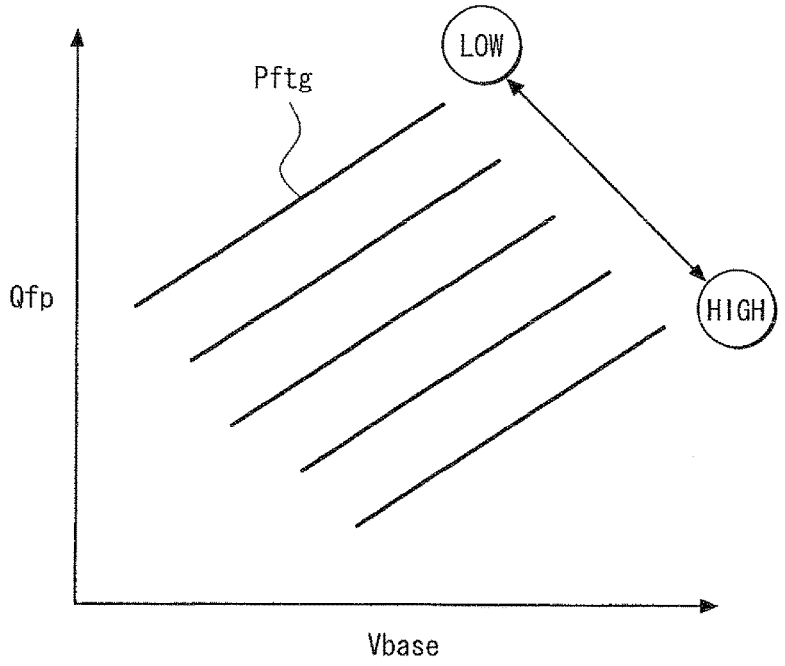
FIG. 5 is a graph conceptually showing a map of a base driving voltage Vbase.

Then, the procedure proceeds to step 105 in which a base drive voltage Vbase of the low-pressure pump 13 is computed according to the target low fuel pressure Pftg and the required discharge rate Qfp. FIG. 5 is a map for obtaining the base drive voltage Vbase, which shows a relationship between the required discharge rate Qfp, the base drive voltage Vbase and the target low fuel pressure Pftg.

Then, the procedure proceeds to step 106 in which a learning correction amount Vlrn is added to the base driving voltage Vbase to obtain a final driving voltage Vfp.

$$Vfp = V\text{base} + Vlrn$$

Then, the procedure proceeds to step 107 in which the computer outputs a control signal to the low-pressure-pump driving circuit 40 so that the driving voltage Vfp is applied to the low-pressure pump 13. Thereby, the low pressure fuel control is executed in which the driving voltage of the low-pressure pump 13 is controlled so that the fuel pressure in the low-pressure fuel passage agrees with the target low fuel pressure Pftg based on the operation characteristic (the map shown in FIG. 5) of the low-pressure pump 13.

When the fuel temperature remaining in the high-pressure pump 16 is extremely high at re-starting engine, the driving voltage of the low-pressure pump 13 is increased to the maximum value so that the discharge rate of the low-pressure pump 13 is made maximum. The pressure regulator 19 regulates the fuel pressure not so as to exceed the specified value.

[Control Error Learning Routine]

The control error learning routine shown in FIG. 4 is executed at a specified time interval while the ECU 39 is energized. This routine functions as a learning means. In step 201, it is determined whether a learning execution condition is satisfied. It should be noted that the learning execution condition includes following conditions:

(1) The engine is at idling state.

(2) The engine is normally driving.

(3) The engine is stopped.

In the above conditions (1)-(3), even if the high-pressure pump 16 is stopped to decrease the fuel pressure in the high-pressure fuel passage, the required fuel injection quantity is substantially constant (or substantially zero) and the fuel pressure in the low-pressure fuel passage is relatively stable.

If one of the above three conditions (1)-(3) is satisfied, the learning execution condition is established. If none of the above is satisfied, the learning execution condition is not established.

The learning execution condition may include further conditions. For example, no malfunction is detected in the high fuel pressure sensor 36 and the low-pressure pump 13, and the fuel temperature is within a specified range.

When the answer is No in step 201, the routine is finished without performing the subsequent steps.

When the answer is Yes in step 201, the procedure proceeds to step 202. In step 202, the solenoid 31 is deenergized to open the fuel pressure control valve 28 so that the high-pressure pump 16 discharges no fuel. Thereby, the fuel pressure in the high pressure fuel passage (delivery pipe 34) decreases along with the fuel injection by the fuel injector 35. Finally, the fuel pressure in the high pressure fuel passage becomes equal to the fuel pressure in the low pressure fuel passage.

In a case that the control error of the low pressure fuel control is learned while the engine is stopped, it is preferable that the discharge operation of the high-pressure pump 16 is stopped before the fuel injection is terminated in order that the fuel pressure in the high pressure fuel passage is decreased. According to the above, when the control error is learned during engine stop, the fuel pressure in the high pressure fuel passage is surely decreased to the fuel pressure in the low pressure fuel passage which can be detected by the high fuel pressure sensor 36.

Then, the procedure proceeds to step 203 in which the target low fuel pressure Pftg is set to a specified pressure (for example, 600 kPa) that is lower than a pressure at which the pressure regulator 19 is opened. Then, the procedure proceeds to step 204 in which the driving voltage correcting amount Vcal of the low-pressure pump 13 is set to an initial value. It should be noted that the initial value of the driving voltage correcting amount Vcal is set to a value at which the fuel pressure of the low pressure fuel passage surely becomes lower than the target low fuel pressure Pftg, for example, −1.0V.

In step 205, the return fuel quantity Qrt is added to the required fuel injection quantity Qeng to obtain the required discharge rate Qfp of the low-pressure pump 13. In step 206, the base driving voltage Vbase is computed according to the target low fuel pressure Pftg and the required discharge rate Qfp by use of a map of the base driving voltage Vbase shown in FIG. 5.

In step 207, the driving voltage correction amount Vcal is added to the base driving voltage Vbase to obtain a final driving voltage Vfp. Then, the procedure proceeds to step 208 in which the computer outputs a control signal to the low-pressure-pump driving circuit 40 so that the driving voltage Vfp is applied to the low-pressure pump 13.

In step 209, the computer stops its procedure until the output of the high fuel pressure sensor 36 becomes stable. After the output of the high fuel pressure sensor 36 becomes stable, the procedure proceeds to step 210 in which the computer determines whether an absolute value of a difference between the detected high fuel pressure Pf and the target low fuel pressure Pftg is less than or equal to a specified value $\alpha$.

When the answer is No in step 210, the procedure proceeds to step 211 in which the driving voltage correcting amount Veal is increased by a specified step amount (for example, 0.1 V). Then, the procedure goes back to step 207. Thereby, the driving voltage Vfp of the low-pressure pump 13 is gradually corrected so that the absolute value of the difference of the detected pressure Pf and the target pressure Pftg becomes less than or equal to the specified value $\alpha$.

When the answer is Yes in step 210, the procedure proceeds to step 212. In step 212, the driving voltage correcting amount Vcal is learned as the control error of the low pressure fuel control (an error in driving voltage of the low-pressure pump 13). This driving voltage correcting amount Vcal is stored in a nonvolatile memory, such as a backup RAM of the ECU 39, as the learning correction amount Vlrn.

In step 106 of FIG. 3, this learning correction amount Vlrn is added to the base driving voltage Vbase to obtain the final driving voltage Vfp. This process corresponds to a correction means.

According to the first embodiment described above, when a specified learning execute condition is established, the high-pressure pump 16 is stopped so that the fuel pressure in the high pressure fuel passage is made equal to the fuel pressure in the low pressure fuel passage. In this condition, the low pressure fuel control is executed to control the driving voltage of the low-pressure pump 13 based on the operational characteristic of the low-pressure pump 13. During the low pressure fuel control, the driving voltage of the low-pressure pump 13 is gradually corrected so that the difference between the detected high fuel pressure and the target low fuel pressure becomes small. When the difference becomes less than or equal to the specified value, the driving voltage correcting amount Vcal is learned as the control error of the low pressure fuel control (an error in driving voltage of the low-pressure pump 13). Thus, the control error in the low pressure fuel control can be learned with high accuracy.

Further, the driving voltage correction amount Vcal is stored as the learning correction amount Vlrn, and the driving voltage of the low-pressure pump 13 is corrected by means of the learning correction amount Vlrn. Therefore, even if a control error arises in the low pressure fuel control due to the individual difference and/or a deterioration with age in low-pressure pump 13 and/or the low-pressure-pump driving circuit 40, the fuel pressure in the low-pressure fuel passage can be accurately adjusted to the target low fuel pressure without generating a vapor.

Furthermore, the high-fuel pressure sensor 36 can detects the fuel pressure in the low pressure fuel passage without providing an additional fuel pressure sensor for detecting the fuel pressure in the low pressure fuel passage. Further, unlike the conventional art, it is unnecessary to actually generate a vapor in the high-pressure pump. Thus, a malfunction due to a vapor can be avoided in the high-pressure pump and a reliability of the fuel supply system can be improved.

Moreover, according to the present embodiment, since the learning execution condition is established when the engine is at idling state, normally driving state, or stopping state, even if the high-pressure pump 16 is stopped to decrease the fuel pressure in the high-pressure fuel passage, the control error in the low pressure fuel control can be learned. Also, when the engine is at idling state, normally driving state or stopping state, the required fuel injection quantity is almost constant (or, zero) so that the fuel pressure in the low pressure fuel passage is stable. Thus, the learning accuracy of the control error using the detected high fuel pressure can be improved.

In the above first embodiment, during the low pressure fuel control, the driving voltage of the low-pressure pump 13 is gradually corrected so that the difference between the detected high fuel pressure and the target low fuel pressure becomes small. When the difference becomes less than or equal to the specified value, the driving voltage correcting amount Vcal is learned as the control error of the low pressure fuel control (an error in driving voltage of the low-pressure pump 13). Alternatively, during the low pressure fuel control, the driving voltage of the low-pressure pump 13 may be feedback controlled in such a manner that so that the detected high fuel pressure agrees with the target low fuel pressure. The driving voltage correcting amount in this feedback control can be learned as the control error of the low pressure fuel control (an error in driving voltage of the low-pressure pump 13). Since the feedback correction amount corresponds to the error in driving voltage of the low-pressure pump, the control error of the low pressure fuel control can be accurately learned by learning the feedback correction amount.

Second Embodiment

Figure 6:
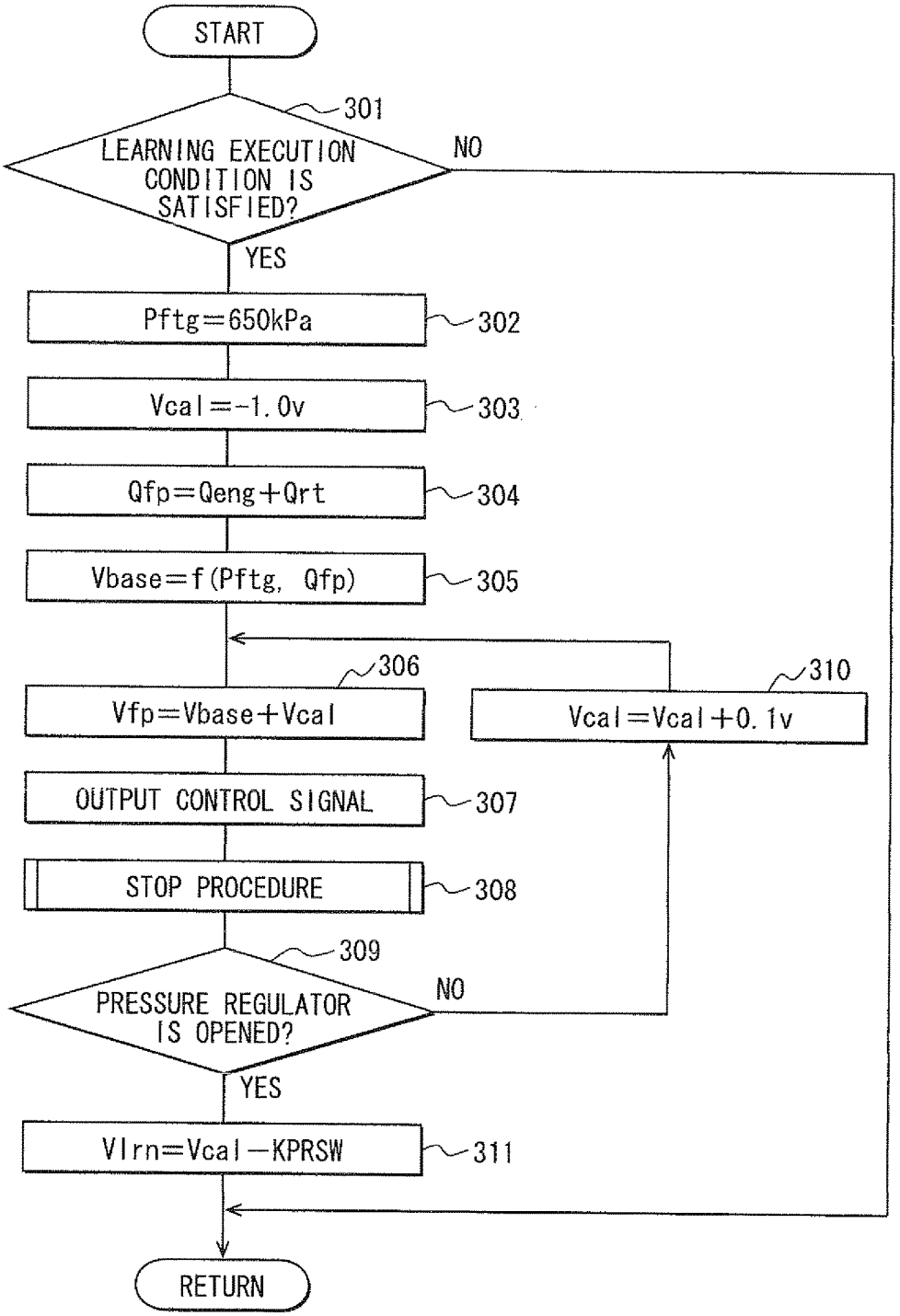
FIG. 6 is a flow chart showing a processing of a control error learning routine according to a second embodiment.

Referring to FIG. 6, a second embodiment will be described hereinafter. In the third and the successive embodiments, the same parts and components as those in the first and the second embodiments are indicated with the same reference numerals and the same descriptions will not be reiterated.

In the second embodiment, as shown by a dashed line in FIG. 1, the pressure regulator 19 is provided with an open-valve detection sensor 41 which detects that the pressure regulator 19 is opened. This open-valve detection sensor 41 detects that a valve body (not shown) of the pressure regulator 19 opens the return pipe 20. Alternatively, the open-valve detection sensor 41 detects that the fuel flows through the return pipe 20.

When the fuel pressure in the low pressure fuel passage becomes larger than a specified value (for example, 650 kPa), the computer executes a control error learning routine shown in FIG. 6. The target low fuel pressure is established in such a manner as to agree with a specified fuel pressure at which the pressure regulator 19 is opened in a case that the specified learning execution condition is established. The low pressure fuel control is executed so that the fuel pressure in the low pressure fuel passage agrees with the target low fuel pressure based on the operational characteristics of the low-pressure pump 13. When the open-valve detection sensor 41 detects that the pressure regulator 19 is opened during the low pressure fuel control, the computer determines that the fuel pressure in the low pressure fuel passage is increased to the target low fuel pressure and learns the control error in the low pressure fuel control (error in driving voltage of the low-pressure pump 13) based on the correction amount of the driving voltage of the low-pressure pump 13. Since the correction amount by which the fuel pressure in the low pressure fuel passage agrees with the target low fuel pressure corresponds to the error in driving voltage of the low-pressure pump 13, the control error in the low pressure fuel control can be accurately learned by use of the correction amount.

In step 301 of FIG. 6, it is determined whether a learning execution condition is satisfied. When the answer is Yes in step 301, the procedure proceeds to step 302 in which the target low fuel pressure Pftg is set to a specified pressure (for example, 650 kPa) that is equal to a pressure at which the pressure regulator 19 is opened. Then, the procedure proceeds to step 303 in which the driving voltage correcting amount Vcal of the low-pressure pump 13 is set to an initial value. It should be noted that the initial value of the driving voltage correcting amount Vcal is set to a value at which the fuel pressure of the low pressure fuel passage surely becomes lower than the target low fuel pressure Pftg, for example, −1.0V.

In step 304, the return fuel quantity Qrt is added to the required fuel injection quantity Qeng to obtain the required discharge rate Qfp of the low-pressure pump 13. In step 305, the base driving voltage Vbase is computed according to the target low fuel pressure Pftg and the required discharge rate Qfp by use of a map of the base driving voltage Vbase shown in FIG. 5.

Then, the procedure proceeds to step 306 in which the driving voltage correction amount Vcal is added to the base driving voltage Vbase to obtain a final driving voltage Vfp. Then, the procedure proceeds to step 307 in which the computer outputs a control signal to the low-pressure-pump driving circuit 40 so that the driving voltage Vfp is applied to the low-pressure pump 13.

In step 308, the computer stops its procedure until the discharge pressure of the low-pressure pump 13 becomes stable. When it is estimated that the discharge pressure of the low-pressure pump 13 has become stable, the procedure proceed to step 309 in which the computer determines whether the pressure regulator 19 is opened based on a signal from the open-valve detection sensor 41.

When the answer is No in step 309, the procedure proceeds to step 310. In step 310, the driving voltage correction amount Vcal is increased by a specified step amount (for example, 0.1 V). Then, the procedure goes back to step 306. Thereby, the driving voltage Vfp of the low-pressure pump 13 is gradually corrected so that the fuel pressure in the low pressure fuel passage is increased until it is detected that the pressure regulator 19 is opened.

When the answer is Yes in step 309, the computer determines that the fuel pressure in the low fuel pressure passage is increased to the target low fuel pressure Pftg. The procedure proceeds to step 311 in which a specified value KPRSW is subtracted from the driving voltage correction amount Vcal. This value (Vcal−KPRSW) is learned as the control error in the low pressure fuel control. The specified value KPRSW is established based on a detection error of the open-valve detection sensor 41, a dynamic hysteresis of the pressure regulator 19 and the like. Further, this value (Vcal−KPRSW) is stored in a nonvolatile memory as a learning correction amount Vlrn.

In step 106 of FIG. 3, this learning correction amount Vlrn is added to the base driving voltage Vbase to obtain the final driving voltage Vfp.

According to the second embodiment described above, when the learning execution condition is established, the target low fuel pressure is established in such a manner as to agree with a specified fuel pressure at which the pressure regulator is opened. In this condition, the low pressure fuel control is executed to control the driving voltage of the low-pressure pump 13 based on the operational characteristic of the low-pressure pump 13. When the open-valve detection sensor 41 detects that the pressure regulator 19 is opened during the low pressure fuel control, the computer determines that the fuel pressure in the low pressure fuel passage is increased to the target low fuel pressure and learns the control error in the low pressure fuel control (error in driving voltage of the low-pressure pump 13) based on the driving voltage correction amount Vcal. Thus, the control error in the low pressure fuel control can be learned with high accuracy.

The present invention should not be limited to the disclosed embodiment, but may be implemented in other ways without departing from the spirit of the invention.

What is claimed is:

1. A fuel-pressure controller for a direct injection engine having a low-pressure pump and a high-pressure pump, the low-pressure pump pumping up a fuel in a fuel tank and supplying the fuel to the high-pressure pump, the high-pressure pump pressurizing the fuel and discharging a high-pressure fuel toward a fuel injector, the fuel-pressure controller comprising:

a low pressure fuel control means for controlling the low-pressure pump in such a manner that a fuel pressure in a low pressure fuel passage agrees with a target low fuel pressure;

a pressure regulator returning the fuel in the low pressure fuel to the fuel tank when the fuel pressure in the low pressure fuel passage becomes greater than or equal to a specified value;

an open-valve detection sensor detecting that the pressure regulator returns the fuel to the fuel tank;

a learning means for executing the low pressure fuel control in a case that a specified learning execution condition is satisfied when the target low fuel pressure is set to the specified value, the learning means for gradually correcting a control amount of the low pressure fuel control so that a fuel pressure in the low pressure fuel passage is increased from a value lower than the specified value, the learning means for learning a control error in the low pressure fuel control based on a correction amount at a time when the open-valve detection sensor detects that the pressure regulator returns the fuel to the fuel tank; and a correction means for correcting the control amount of the low pressure fuel control based on the control error learned by the learning means, wherein the low pressure fuel control means varies the target low fuel pressure within a fuel pressure range which is lower than the specified value according to a driving condition of the engine.

2. A fuel-pressure controller for a direct injection engine having a low-pressure pump and a high-pressure pump, the low-pressure pump configured to pump up a fuel in a fuel tank and supply the fuel to the high-pressure pump, the high-pressure pump configured to pressurize the fuel and discharge a high-pressure fuel toward a fuel injector, the fuel-pressure controller comprising:

a low pressure fuel controller configured to control the low-pressure pump in such a manner that a fuel pressure in a low pressure fuel passage agrees with a target low fuel pressure;

a pressure regulator configured to return the fuel in the low pressure fuel to the fuel tank when the fuel pressure in the low pressure fuel passage becomes greater than or equal to a specified value;

an open-valve detection sensor configured to detect that the pressure regulator returns the fuel to the fuel tank; and an electronic control unit, comprising a computer processor, the electronic control unit configured to:

execute the low pressure fuel control in a case that a specified learning execution condition is satisfied when the target low fuel pressure is set to the specified value, gradually correct a control amount of the low pressure fuel control so that a fuel pressure in the low pressure fuel passage is increased from a value lower than the specified value, learn a control error in the low pressure fuel control based on a correction amount at a time when the open-valve detection sensor detects that the pressure regulator returns the fuel to the fuel tank, and correct the control amount of the low pressure fuel control based on the learned control error, wherein the low pressure fuel controller is further configured to vary the target low fuel pressure within a fuel pressure range which is lower than the specified value according to a driving condition of the engine.

* * * * *